US008276652B2

(12) United States Patent
Zhang et al.

(10) Patent No.: US 8,276,652 B2
(45) Date of Patent: Oct. 2, 2012

(54) HIGH PERFORMANCE LOUVERED FIN FOR HEAT EXCHANGER

(75) Inventors: Chao A. Zhang, Plymouth, MI (US); Haiping Hong, Canton, MI (US); William Melnyk, Lathrup Village, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 664 days.

(21) Appl. No.: 12/484,555

(22) Filed: Jun. 15, 2009

(65) Prior Publication Data

US 2009/0250199 A1 Oct. 8, 2009

Related U.S. Application Data

(62) Division of application No. 11/403,311, filed on Apr. 13, 2006, now abandoned.

(51) Int. Cl.
*F28F 1/30* (2006.01)
*F28D 1/04* (2006.01)

(52) U.S. Cl. ..... 165/152; 165/182

(58) Field of Classification Search ..... 165/181, 165/182, 151, 152, 185, 80.3, 140; *F28F 001/30*
See application file for complete search history.

(56) References Cited

U.S. PATENT DOCUMENTS

| | | | | |
|---|---|---|---|---|
| 3,250,325 | A | 5/1966 | Rhodes et al. | |
| 5,035,052 | A | 7/1991 | Suzuki et al. | |
| 5,036,911 | A | 8/1991 | So et al. | |
| 5,509,469 | A * | 4/1996 | Obosu | 165/151 |
| 5,730,214 | A * | 3/1998 | Beamer et al. | 165/152 |
| 5,887,649 | A | 3/1999 | Kim | |
| 6,543,527 | B1 * | 4/2003 | Bouzida et al. | 165/152 |
| 6,805,193 | B2 | 10/2004 | Hu et al. | |
| 7,428,920 | B2 * | 9/2008 | Antonijevic | 165/152 |
| 2002/0129929 | A1 | 9/2002 | Iwasaki et al. | |
| 2003/0136554 | A1 * | 7/2003 | Hu et al. | 165/151 |
| 2004/0112578 | A1 * | 6/2004 | Iwasaki | 165/165 |
| 2004/0206484 | A1 | 10/2004 | Shimoya et al. | |
| 2005/0016718 | A1 | 1/2005 | Papapanu et al. | |
| 2006/0266503 | A1 | 11/2006 | Yamauchi | |
| 2007/0051502 | A1 | 3/2007 | Yamauchi | |

FOREIGN PATENT DOCUMENTS

| | | | |
|---|---|---|---|
| DE | 10 2004 001 306 | | 8/2005 |
| DE | 10 2004 012 427 | A1 | 9/2005 |
| EP | 1 793 190 | A1 | 6/2007 |
| JP | 49-1938 | | 1/1974 |
| JP | 2003083690 | A * | 3/2003 |
| KR | 2002075659 | A * | 10/2002 |
| WO | WO 2004/102 102 | A1 | 11/2004 |

* cited by examiner

*Primary Examiner* — Tho V Duong
(74) *Attorney, Agent, or Firm* — Fraser Clemens Martin & Miller LLC; J. Douglas Miller

(57) ABSTRACT

A high performance louvered fin for a heat exchanger is disclosed, wherein adjacent entrance louvers have increased widths and adjacent exit louvers have decreased widths in order to optimize thermal efficiency.

20 Claims, 5 Drawing Sheets

HIGH PERFORMANCE LOUVERED FIN FOR HEAT EXCHANGER

CROSS-REFERENCE TO RELATED APPLICATIONS

This application is a divisional of U.S. patent application Ser. No. 11/403,311 filed on Apr. 13, 2006. The entire disclosure of the above application is hereby incorporated herein by reference.

FIELD OF THE INVENTION

The invention relates to heat exchangers and more particularly to high performance louvered fins for heat exchangers.

BACKGROUND OF THE INVENTION

An air-cooled fin-type heat exchanger is very well known. Heat exchangers are used for changing the temperature of various working fluids, such as an engine coolant, an engine lubricating oil, an air conditioning refrigerant, and an automatic transmission fluid, for example. The heat exchanger typically includes a plurality of spaced apart fluid conduits or tubes connected between an inlet tank and an outlet tank, and a plurality of heat exchanging fins disposed between adjacent conduits. Air is directed across the fins of the heat exchanger by a cooling fan or a motion of a vehicle, for example. As the air flows across the fins, heat in a fluid flowing through the tubes is conducted through the walls of the tubes, into the fins, and transferred into the air.

One of the primary goals in heat exchanger design is to achieve the highest possible thermal efficiency. Thermal efficiency is measured by dividing the amount of heat that is transferred by the heat exchanger under a given set of conditions (amount of airflow, temperature difference between the air and fluid, and the like) by the theoretical maximum possible heat transfer under those conditions. Thus, an increase in the rate of heat transfer results in a higher thermal efficiency.

Typically, to improve thermal efficiency the airflow must be improved and/or a pressure drop through the heat exchanger must be reduced. Improved heat exchanger performance can be accomplished by forming the fins and/or louvers on the fins at a predetermined angle in a manner also well known in the art. Pressure drop is associated with the change in airflow direction caused by the louvered fins. A higher air pressure drop can result in a lower heat transfer rate. Various types of fin and louver designs have been disclosed in the prior art with the object of increasing the heat exchanger efficiency by making improvements in the fins, louvers, and airflow pattern.

Examples of these prior art fin and louver designs include an addition of fin rows in order to increase the amount of air encountered by the heat exchanger. Other designs include louvers formed at an angle to the fin wall, rather than square to the fin wall. Further, the prior art discloses heat exchangers with multiple changes of airflow direction. Air flows through the louvers until a middle transition piece or turnaround rib is reached. The air then changes direction and flows through exit louvers to exit the heat exchanger. Fin design continues to play an important role in increasing heat exchanger efficiency.

It would be desirable to produce a fin for a heat exchanger whereby a pressure drop associated therewith is minimized and an airflow through the heat exchanger is maximized.

SUMMARY OF THE INVENTION

In concordance with the instant disclosure, a fin for a heat exchanger whereby a pressure drop associated therewith is minimized and an airflow through the heat exchanger is maximized, has been discovered.

In one embodiment, a flat tube heat exchanger comprises at least one header; a plurality of spaced apart tubes in fluid communication with the header; and a plurality of fins disposed between the tubes, the fins further comprising: a base wall having a longitudinal axis, a first end, a second end, and a middle portion; at least one turnaround rib disposed in the middle portion of the base wall; a plurality of spaced apart entrance louvers disposed between the first end of the base wall and the turnaround rib, the entrance louvers having a first edge and a second edge, a width of each of the entrance louvers defined as a distance between the first edge of each of the entrance louvers and the second edge of each of the entrance louvers, wherein the width of at least one of the entrance louvers is greater than the width of a remainder of the entrance louvers; and a plurality of spaced apart exit louvers disposed between the turnaround rib and the second end of the base wall, the exit louvers having a first edge and a second edge, a width of each of the exit louvers defined as a distance between the first edge of each of the exit louvers and the second edge of each of the exit louvers, wherein the width of at least one of the exit louvers is greater that the width of a remainder of the exit louvers, is disclosed.

In another embodiment, a high performance heat exchanger fin comprises a base wall having a first end, a second end, and a middle portion; at least one turnaround rib disposed in the middle portion of the base wall; a plurality of spaced apart entrance louvers having a longitudinal axis, a first edge, and a second edge, the entrance louvers disposed between the first end of the base wall and the turnaround rib, a width of each of the entrance louvers defined as a distance between the first edge and the second edge, wherein the width of the entrance louvers increases moving in a direction from the first end to the second end of the base wall, each of the entrance louvers disposed at a predetermined angle in respect of the longitudinal axis of the entrance louver, the predetermined angle decreasing for at least one of the entrance louvers moving in a direction from the first end to the second end of the base wall; and a plurality of spaced apart exit louvers having a longitudinal axis, a first edge, and a second edge, the exit louvers disposed between the turnaround rib and the second end of the base wall, a width of each of the exit louvers defined as a distance between the first edge and the second edge, wherein the width of the exit louvers decreases moving in a direction from the first end to the second end of the base wall, each of the exit louvers disposed at a predetermined angle in respect of the longitudinal axis of the base exit louvers, the predetermined angle decreasing for at least one of the exit louvers moving in a direction from the first end to the second end of the base wall, is disclosed.

In another embodiment, a high performance heat exchanger fin comprises a base wall having a first end, a second end, and a middle portion, the base wall having a first longitudinal axis extending from the first end to the middle portion and a second longitudinal axis extending from the middle portion to the second end, whereby the first longitudinal axis and the second longitudinal axis are non-linear; at least one turnaround rib disposed in the middle portion of the base wall; a plurality of spaced apart entrance louvers having a first edge and a second edge, the entrance louvers disposed between the first end of the base wall and the turnaround rib, a width of each of the entrance louvers defined as a distance between the first edge and the second edge, wherein the width of the entrance louvers increases moving in a direction from the first end to the second end of the base wall; and a plurality of spaced apart exit louvers having a first edge and a second edge, the exit louvers disposed between the turnaround rib and the second end of the base wall, a width of each of the exit louvers defined as a distance between the first edge and the second edge, wherein the width of the exit louvers decreases moving in a direction from the first end to the second end of the base wall, is disclosed.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner.

Figure 1:
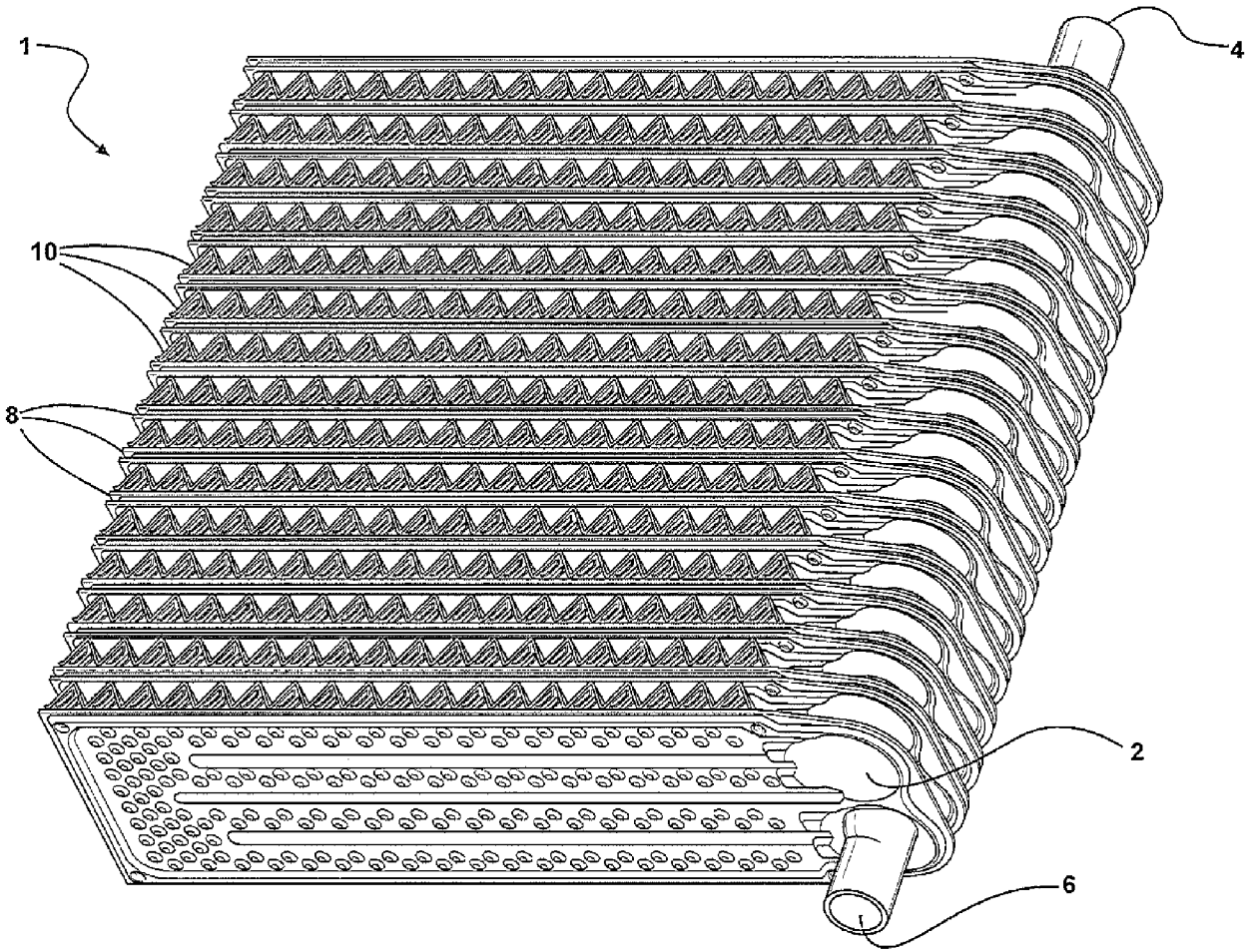
FIG. 1 is a perspective view of a flat tube heat exchanger including a high performance heat exchanger fin in accordance with an embodiment of the invention.

FIG. 1 shows a flat tube heat exchanger 1 in accordance with an embodiment of the current invention. The heat exchanger 1 includes a tank or header 2 having a fluid inlet 4 and a fluid outlet 6. A plurality of flat tubes 8 are in fluid communication with the tank 2. A plurality of high performance heat exchanger fins 10 is disposed between each of the flat tubes 8. It is understood that more or fewer flat tubes 8 and fins 10 can be used as desired without departing from the spirit or scope of the invention.

Figure 2:
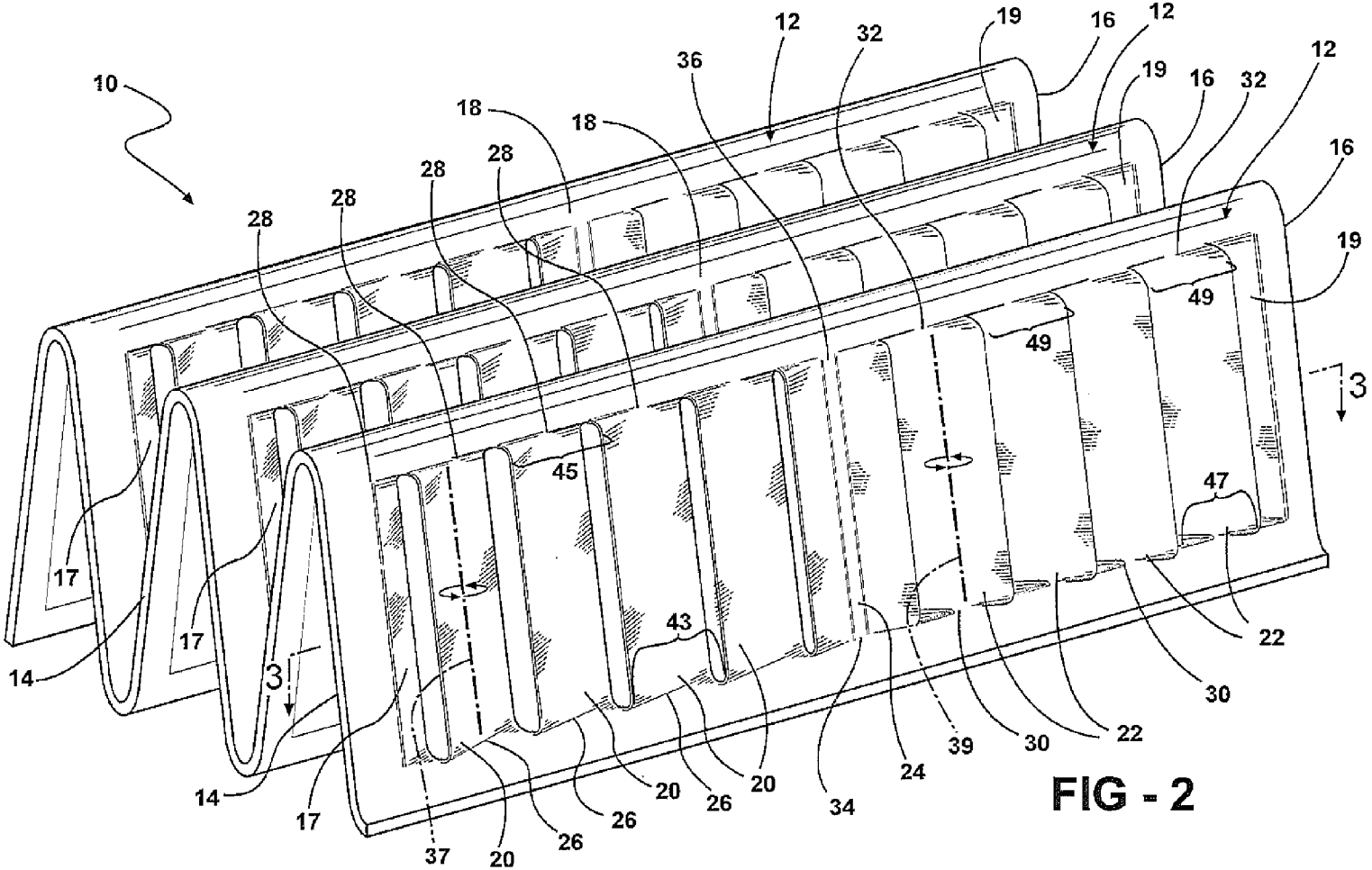
FIG. 2 is a perspective view of the high performance heat exchanger fin illustrated in FIG. 1.

The high performance heat exchanger fins 10 are more clearly shown in FIG. 2. The heat exchanger fins 10 include a plurality of base walls 12. It is understood that more or fewer base walls 12 can be used without departing from the spirit or scope of the invention. The base walls 12 include a first end 14, a spaced apart second end 16, and a middle portion 18 disposed therebetween.

The base walls 12 include a leading edge louver 17, a trailing edge louver 19, a plurality of entrance louvers 20, a plurality of exit louvers 22, and a turnaround rib 24. The leading edge louver 17 and the entrance louvers 20 are connected to the base wall 12 at a first end 26 and a spaced apart second end 28. The entrance louvers 20 are pivoted about a bend axis 37 to dispose each of the louvers 20 at a predetermined angle $\alpha$ from the base wall 12. The trailing edge louver 19 and the exit louvers 22 are connected to the base wall 12 at a first end 30 and a spaced apart second end 32. The exit louvers 22 are pivoted about a bend axis 39 to dispose each of the louvers 22 at a predetermined angle $\beta$ from the base wall 12. The turnaround rib 24 is connected to the base wall 12 at a first end 34 and at a spaced apart second end 36.

Figure 3:
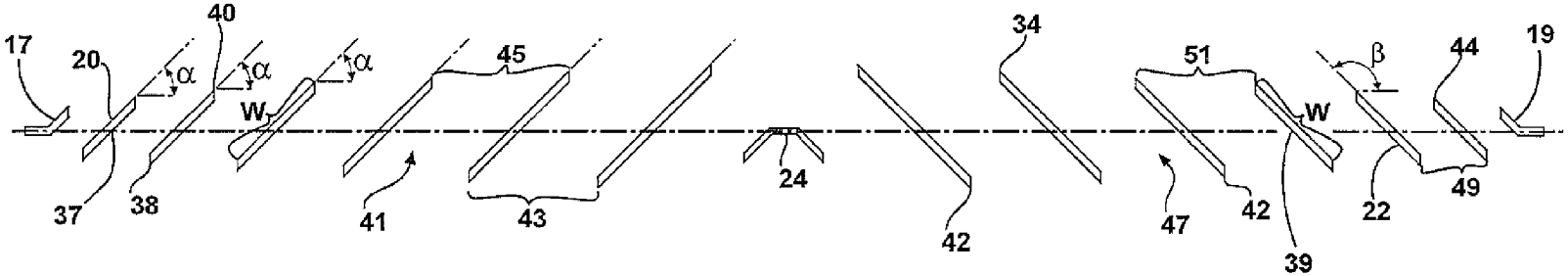
FIG. 3 is a top sectional view of a plurality of louvers of the high performance heat exchanger fin of FIG. 2 taken along line 3-3.

As more clearly shown in FIG. 3, each of the entrance louvers 20 includes a first edge 38 and a spaced apart second edge 40. A gap 41 is formed between adjacent entrance louvers 20. A first distance 43 is measured in the gap 41 between the first edges 38 of adjacent entrance louvers 20, and a second distance 45 is measured between the second edges 40 of adjacent entrance louvers 20.

A width W of each of the entrance louvers 20 is defined as the distance between the first edge 38 and the second edge 40 thereof. In the embodiment shown, the width W of adjacent entrance louvers 20 varies. Each adjacent entrance louver 20 has a slightly greater width W from the entrance louver 20 adjacent the first end 14 of the base wall 12 to the entrance louver 20 adjacent the turnaround rib 24. Thus, the width W of the entrance louver 20 adjacent the first end 14 of the base wall 12 is smaller than the width W of each of the remaining entrance louvers 20 leading to the turnaround rib 24. The first edge 38 and the second edge 40 of each entrance louver 20 extend laterally outwardly from a longitudinal axis of the entrance louvers 20 further than the first edge 38 and the second edge 40 of each entrance louver 20 moving from the first end 14 of the base wall 12 to the turnaround rib 24. This change in lateral extension is a result of the difference in width W of adjacent entrance louvers 20. In this embodiment, the predetermined angle $\alpha$ from the base wall 12 remains substantially constant for each of the entrance louvers 20.

Each of the exit louvers 22 includes a first edge 42 and a spaced apart second edge 44. A gap 47 is formed between adjacent exit louvers 22. A first distance 49 is measured in the gap 47 between the first edges 42 of adjacent exit louvers 22, and a second distance 51 is measured between the second edges 44 of adjacent exit louvers 22.

A width W of each of the exit louvers 22 is defined as the distance between the first edge 42 and the second edge 44 thereof. In the embodiment shown, the width W of adjacent exit louvers 22 varies. Each adjacent exit louver 22 has a slightly smaller width W when moving from the turnaround rib 24 to the second end 16 of the base wall 12. To account for a difference in the width W of adjacent exit louvers 22, the first edge 42 and the second edge 44 of each exit louver 22 does not extend laterally outwardly as far as the first edge 42 and the second edge 44 of an adjacent exit louver 22 moving from the exit louver 22 adjacent the turnaround rib 24 to the exit louver 22 adjacent the second end 16 of the base wall 12. In this embodiment, the predetermined angle $\beta$ from the base wall 12 remains substantially constant for each of the exit louvers 22.

As in known in the art, air is caused to flow through the gaps 41 between the entrance louvers 20. Heat removed from the fluid located in the flat flow tubes 8 is transferred through the heat exchanger fin 10 and the entrance louvers 20 to the air. The air is then turned at the turnaround rib 24. The air flows through the gaps 47 between the exit louvers 22 where additional heat is transferred from the exit louvers 22 to the air.

A pressure drop through the louvers 20, 22 is minimized. The increase in the width W of adjacent entrance louvers 20 and the decrease in the width W of adjacent exit louvers 22 helps accomplish these benefits by minimizing frictional losses and maximizing an exposed surface of the louvers 20, 22. For the embodiment shown in FIGS. 1 and 2, at least a 15% reduction in pressure drop has been measured.

Figure 4:
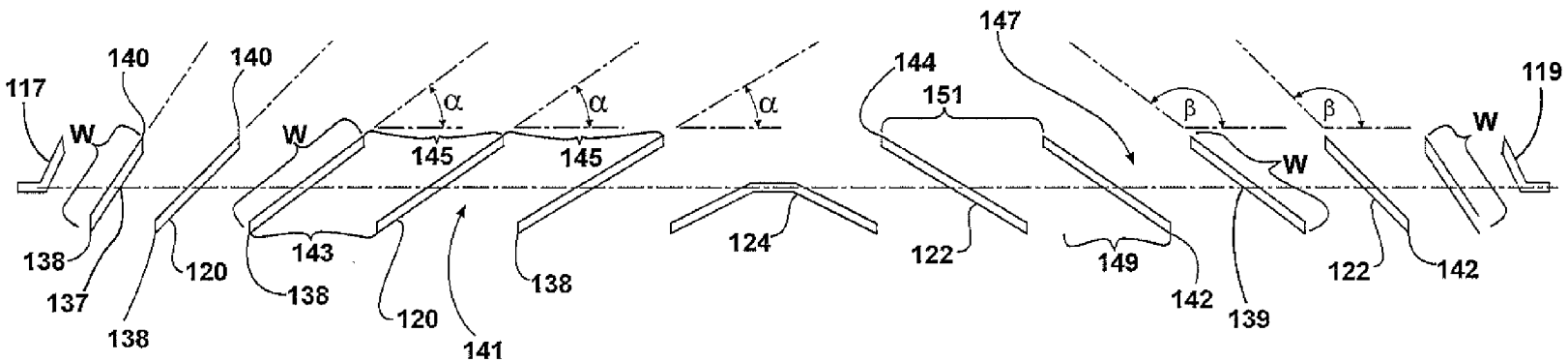
FIG. 4 is a top sectional view of a plurality of louvers in accordance with another embodiment of the invention.

FIG. 4 shows a leading edge louver 117, a trailing edge louver 119, a plurality of entrance louvers 120, a plurality of exit louvers 122, and a turnaround rib 124 in accordance with another embodiment of the invention. The leading edge louver 117 is connected to a base wall (not shown) as discussed above for FIG. 2. The entrance louvers 120 include a first edge 138 and a spaced apart second edge 140, and are connected to a base wall as discussed for the FIG. 2. The entrance louvers 120 are pivoted about a bend axis 137 to dispose each of the louvers 120 at a predetermined angle α from the base wall. A gap 141 is formed between adjacent entrance louvers 120. A first distance 143 is measured between the first edges 138 of adjacent entrance louvers 120. A second distance 145 is measured in the gap 141 between the second edges 140 of adjacent entrance louvers 120.

Each of the entrance louvers 120 is disposed at the predetermined angle α from the base wall. In this embodiment, to account for a difference in the width W of adjacent entrance louvers 120, the predetermined angle α of each entrance louver 120 moving from the first end of the base wall to the turnaround rib 124 is decreased. The angle α is decreased by an amount in order to maintain all of the first edges 138 of the entrance louvers 120 in substantially the same plane, and all of the second edges 140 of the entrance louvers 120 in substantially the same plane.

The trailing edge louver 119 is connected to the base wall as discussed above for FIG. 2. The exit louvers 122 include a first edge 142 and a spaced apart second edge 144, and are connected to a base wall as discussed for the FIG. 2. The exit louvers 122 are pivoted about a bend axis 139 to dispose each of the louvers 122 at a predetermined angle β from the base wall. A gap 147 is formed between adjacent exit louvers 122. A first distance 149 is measured in the gap 147 between the first edges 142 of adjacent exit louvers 122 and a second distance 151 is measured in the gap 147 between the second edges 144 of adjacent exit louvers 122.

Each of the exit louvers 122 is disposed at the predetermined angle β from the base wall. The predetermined angle β of each exit louver 122 moving from the turnaround rib 124 to the second end of the base wall is decreased. The angle β is decreased by an amount to maintain the first edges 142 of the exit louvers 122 in substantially the same plane. Likewise, the decreasing angle β maintains the second edges 144 of the exit louvers 122 in substantially the same plane. Air flow through the louvers 117, 119, 120, 122 is the same as described above for FIG. 3.

Figure 5:
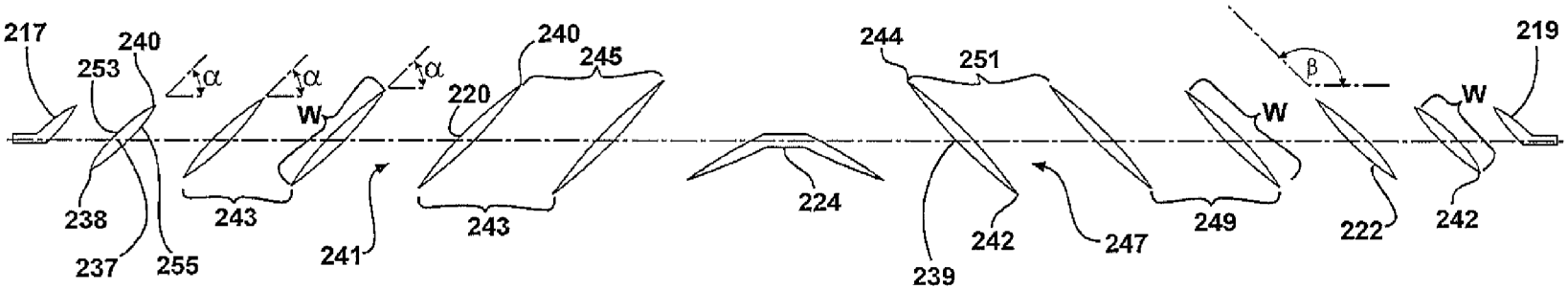
FIG. 5 is a top sectional view of a plurality of louvers in accordance with another embodiment of the invention.

FIG. 5 shows a leading edge louver 217, a trailing edge louver 219, a plurality of entrance louvers 220, a plurality of exit louvers 222, and a turnaround rib 224 in accordance with another embodiment of the invention. The leading edge louver 217 is connected to a base wall (not shown) as discussed above for FIG. 2. Each of the entrance louvers 220 includes a first edge 238 and a spaced apart second edge 240, and is connected to a base wall as discussed above for FIG. 2. The entrance louvers 220 are pivoted about a bend axis 237 to dispose each of the louvers 220 at a predetermined angle α from the base wall. Adjacent entrance louvers 220 include a gap 241 formed therebetween. A first distance 243 is measured in the gap 241 between the first edges 238 of adjacent entrance louvers 220, and a second distance 245 is measured in the gap 241 between the second edges 240 of adjacent entrance louvers 220.

The trailing edge louver 219 is connected to the base wall as discussed above for FIG. 2. Each of the exit louvers 222 includes a first edge 242 and a spaced apart second edge 244, and is connected to a base wall as discussed above for FIG. 2. The exit louvers 222 are pivoted about a bend axis 239 to dispose each of the louvers 222 at a predetermined angle β from the base wall. A gap 247 is formed between adjacent exit louvers 222. A first distance 249 is measured in the gap 247 between the first edges 242 of adjacent exit louvers 222 and a second distance 251 is measured in the gap 247 between the second edges 244 of adjacent exit louvers 222.

A first convex curved surface 253 and a second convex curved surface 255 extend between the first edge 238 and the second edge 240 of the entrance louvers 220, and the first edges 242 and the second edges 244 of the exit louvers 222 over an entire length thereof. The first convex curved surface 253 and the second convex curved surface 255 cooperate to generally form an oval or football shape in cross section.

Adjacent entrance louvers 220 and exit louvers 222 include the same width pattern as discussed above for FIG. 4. The entrance louvers 220 have a width W that increases from the entrance louver 220 adjacent the first end of the base wall to the entrance louver 220 adjacent the turnaround rib 224. The exit louvers 222 have a width W that decreases from the exit louver 222 adjacent the turnaround rib 224 to the exit louver 222 adjacent the second end of the base wall.

Each of the entrance louvers 220 is disposed at the predetermined angle α from the base wall. In this embodiment, the predetermined angle α is decreased by an amount necessary to maintain the first edges 238 of the entrance louvers 220 in substantially the same plane and the second edges 240 of the entrance louvers 220 in substantially the same plane.

Each of the exit louvers 222 is disposed at the predetermined angle β from the base wall. Similar to the description above for the entrance louvers 220, the predetermined angle β is decreased. The angle β is decreased by an amount necessary to maintain the first edges 242 of the exit louvers 222 in substantially the same plane. Similarly, the second edges 244 of the exit louvers 222 are maintained in substantially the same plane. It is understood that the louvers 220, 222 can include the same width W pattern as those described above for FIG. 3, wherein the angles α, β between adjacent louvers 220, 222 remain substantially constant. Air flow through the louvers 217, 219, 220, 222 is the same as described above for FIG. 3.

Figure 6:
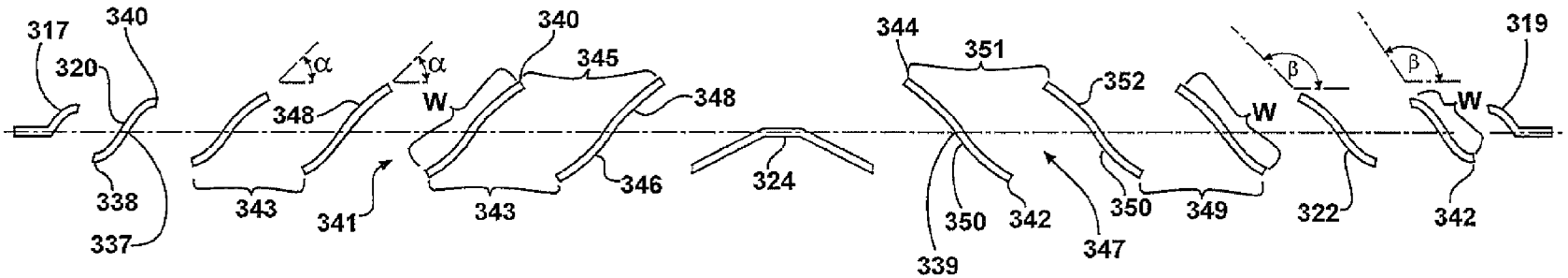
FIG. 6 is a top sectional view of a plurality of louvers in accordance with another embodiment of the invention.

FIG. 6 shows a leading edge louver 317, a trailing edge louver 319, a plurality of entrance louvers 320, a plurality of exit louvers 322, and a turnaround rib 324 in accordance with another embodiment of the invention. The leading edge louver 317 is connected to the base wall (not shown) as discussed above for FIG. 2. Each of the entrance louvers 320 includes a first edge 338 and a spaced apart second edge 340. Each of the louvers 320, 322 is connected to a base wall as previously described for FIG. 2. The entrance louvers 320 are pivoted about a bend axis 337 to dispose each of the louvers 320 at a predetermined angle α from the base wall. A gap 341 is formed between adjacent entrance louvers 320. A first distance 343 is measured between the first edges 338 of adjacent entrance louvers 320. A second distance 345 is measured in the gap 341 between the second edges 340 of adjacent entrance louvers 320.

A first bend 346 and a second bend 348 are formed between the first edge 338 and the second edge 340 of the entrance louvers 320. In the embodiment shown, the first bend 346 is formed in a direction opposite the second bend 348, resulting in a generally S-shaped structure in cross section.

The trailing edge louver 319 is connected to the base wall as discussed above for FIG. 2. The exit louvers 322 include a first edge 342 and a spaced apart second edge 344, and are connected to a base wall as discussed for the previous embodiments. The exit louvers 322 are pivoted about a bend axis 339 to dispose each of the louvers 322 at a predetermined angle β from the base wall. A gap 347 is formed between adjacent exit louvers 322. A first distance 349 is measured in the gap 347 between the first edges 342 of adjacent exit louvers 322 and a second distance 351 is measured in the gap 347 between the second edges 344 of adjacent exit louvers 322.

A first bend 350 and a second bend 352 are formed in the exit louvers 322 between the first edge 342 and the second edge 344 thereof. Thus, a cross sectional shape of the exit louvers 322 is generally a reverse S.

Adjacent entrance louvers 320 and adjacent exit louvers 322 include the same width pattern as discussed above for FIG. 4. A width W of the entrance louvers 320 increases from the entrance louver 320 adjacent the first end of the base wall to the entrance louver 320 adjacent the turnaround rib 324. The increase in the width W can result from a change in the distance between the first edge 338 and the first bend 346, the first bend 346 and the second bend 348, the second bend 348 and the second edge 340, or any other combination thereof.

The exit louvers 322 have a width W that decreases from the exit louver 322 adjacent the turnaround rib 324 to the exit louver 322 adjacent the second end of the base wall. The decrease in the width W can result from a change in the distance between the first edge 342 and the first bend 350, the first bend 350 and the second bend 352, the second bend 352 and the second edge 344, or any other combination thereof.

The first edges 338 of the entrance louvers 320 and the second edges 340 of the entrance louvers 320 are disposed at the predetermined angle α from the base wall. In this embodiment, to account for a difference in the width W between adjacent entrance louvers 320, the predetermined angle α of each entrance louver 320 is decreased. The angle α is decreased by an amount necessary to maintain all of the first edges 338 of the entrance louvers 320 in substantially the same plane and all of the second edges 340 of the entrance louvers 320 in substantially the same plane.

The first edges 342 of the exit louvers 322 and the second edges 344 of the exit louvers 322 are disposed at the predetermined angle β from the base wall. The predetermined angle β of each exit louver 322 moving from the middle portion to the second end is decreased. The angle β is decreased by an amount to maintain the first edges 342 of the exit louvers 322 in substantially the same plane. Likewise, the decreasing angle β maintains the second edges 344 of the exit louvers 322 in substantially the same plane. It is understood that the louvers 320, 322 may have the same width W pattern as those described for FIG. 3 above, wherein the angles α, β between adjacent louvers 320, 322 remain substantially constant. Air flow through the louvers 317, 319, 320, 322 is the same as described above for FIG. 3.

Figure 7:
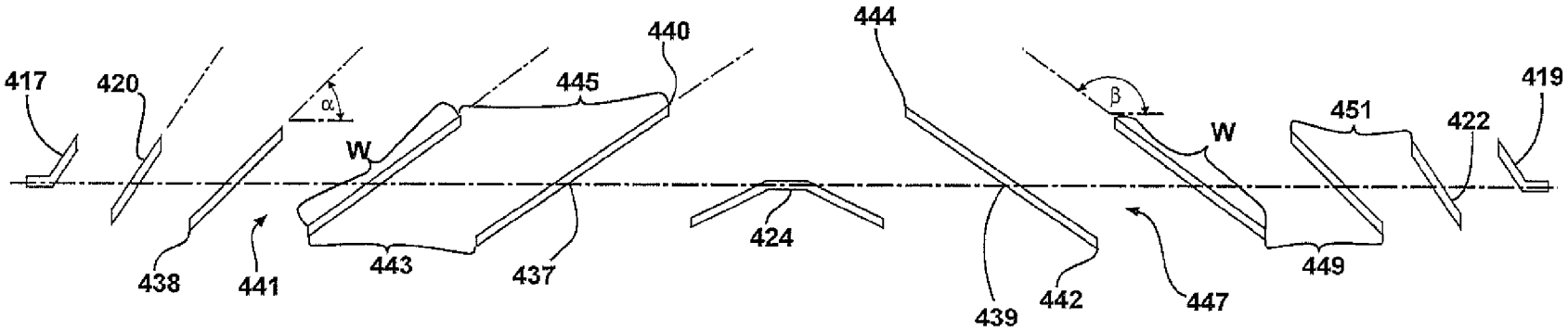
FIG. 7 is a top sectional view of a plurality of louvers in accordance with another embodiment of the invention.

FIG. 7 shows a leading edge louver 417, a trailing edge louver 419, a plurality of entrance louvers 420, a plurality of exit louvers 422, and a turnaround rib 424 in accordance with another embodiment of the invention. The leading edge louver 417 is connected to a base wall (not shown) as discussed above for FIG. 2. Each of the entrance louvers 422 includes a first edge 438 and a spaced apart second edge 440, and is connected to a base wall as discussed above for FIG. 2. The entrance louvers 420 are pivoted about a bend axis 437 to dispose each of the louvers 420 at a predetermined angle α from the base wall. A gap 441 is formed between adjacent entrance louvers 420. A first distance 443 is measured in the gap 441 between the first edges 438 of adjacent entrance louvers 420, and a second distance 445 is measured between the second edges 440 of adjacent entrance louvers 420.

A width W of the entrance louvers 420 is defined as the distance between the first edge 438 and the second edge 440. The width W of adjacent entrance louvers 420 varies. Each adjacent entrance louver 420 has a slightly greater width W from the entrance louver 420 adjacent the first end of the base wall to the entrance louver 420 adjacent the turnaround rib 424. Thus, the width W of the entrance louver 420 adjacent the first end of the base wall is smaller than the width W of each of the remaining entrance louvers 420 leading to the turnaround rib 424. In this embodiment, the predetermined angle α from the base wall remains substantially constant for each of the entrance louvers 420.

In this embodiment, to account for a difference in the width W of adjacent entrance louvers 420, a decrease in the predetermined angle α between louvers as described in FIG. 4 is combined with the increase of the extension of the edges of the adjacent louvers as described in FIG. 3. A gap 441 is formed between adjacent entrance louvers 420. A first distance 443 is measured in the gap 441 between first edges 438 of adjacent entrance louvers 420, and a second distance 445 is measured in the gap 441 between second edges 440 of adjacent entrance louvers 420.

The trailing edge louver 419 is connected to the base wall as discussed above for FIG. 2. The exit louvers 422 include a first edge 442 and a spaced apart second edge 444, and are connected to a base wall as discussed for the FIG. 2. The exit louvers 422 are pivoted about a bend axis 439 to dispose each of the louvers 422 at a predetermined angle β from the base wall. A gap 447 is formed between adjacent exit louvers 422. A first distance 449 is measured in the gap 447 between the first edges 442 of adjacent exit louvers 422, and a second distance 451 is measured between the second edges 444 of adjacent exit louvers 422.

A width W of the exit louvers 422 is defined as the distance between the first edge 442 and the second edge 444. The width W of adjacent exit louvers 422 varies. Each adjacent exit louver 422 has a slightly smaller width W when moving from the turnaround rib 424 to the second end of the base wall. In this embodiment, the predetermined angle β from the base wall remains substantially constant for each of the exit louvers 422.

In this embodiment, to account for a difference in the width W of adjacent exit louvers 422, the predetermined angle β for each of the exit louvers 422 is decreased for each of the exit louvers 422 moving from a turnaround rib 424 to the second end of the base wall (not shown). Additionally, a decrease in the extension of the first edges 442 and the second edges 444 of the adjacent exit louvers 422 as described in FIG. 3 is provided.

Air flow through the louvers 417, 419 420, 422 is the same as described above for FIG. 3. It is understood that football shaped louvers as discussed in FIG. 5, and S-shaped louvers and reversed S-shaped louvers as discussed in FIG. 6 can be replaced for the louvers shown in this embodiment.

Figure 8:
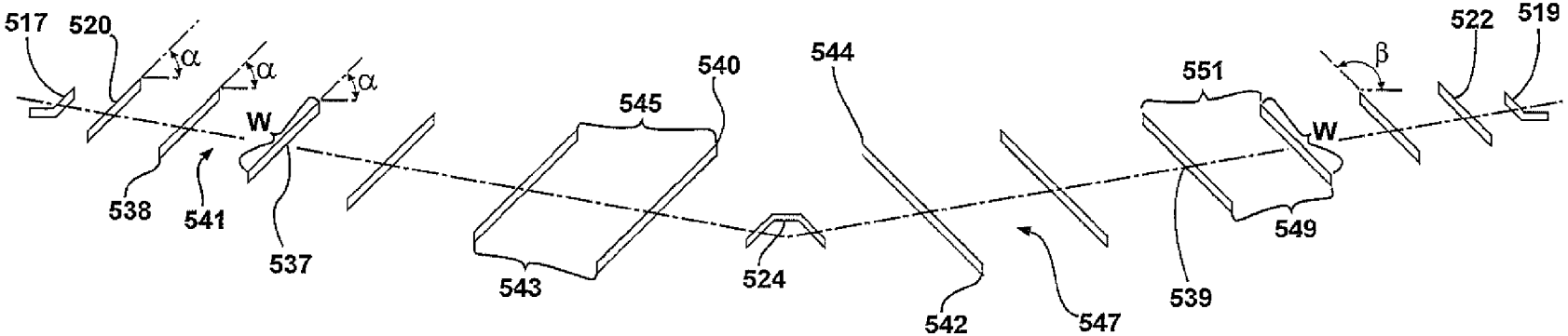
FIG. 8 is a top sectional view of a plurality of louvers in accordance with another embodiment of the invention.

In another embodiment shown in FIG. 8, the fin (not shown) is bent along the length of the middle portion of a base wall (not shown) to form a first portion of the base wall and a second portion of the base wall. The bend along the middle portion forms the entrance louvers 520 and the exit louvers 522 in a staggered pattern.

There is shown a leading edge louver 517, a trailing edge louver 519, a plurality of entrance louvers 520, a plurality of exit louvers 522, and a turnaround rib 524. The leading edge louver 517 is connected to the base wall as discussed above for FIG. 2. Each of the entrance louvers 520 includes a first edge 538 and a spaced apart second edge 540, and is connected to the base wall as discussed above for FIG. 2. The entrance louvers 520 are pivoted about a bend axis 537 to dispose each of the entrance louvers 520 at a predetermined angle α from the base wall. Adjacent entrance louvers 520 include a gap 541 formed therebetween. A first distance 543 is measured in the gap 541 between the first edges 538 of adjacent entrance louvers 520, and a second distance 545 is measured in the gap 541 between the second edges 540 of adjacent entrance louvers 520.

The trailing edge louver 519 is connected to the base wall as discussed above for FIG. 2. Each of the exit louvers 522 includes a first edge 542 and a spaced apart second edge 544, and is connected to a base wall as discussed above for FIG. 2. The exit louvers 522 are pivoted about a bend axis 539 to dispose each of the louvers 522 at a predetermined angle β from the base wall. A gap 547 is formed between adjacent exit louvers 522. A first distance 549 is measured in the gap 547 between the first edges 542 of adjacent exit louvers 522 and a second distance 551 is measured in the gap 547 between the second edges 544 of adjacent exit louvers 522.

Adjacent entrance louvers 520 and exit louvers 522 include the same width pattern as discussed above for FIG. 3. The entrance louvers 520 have a width W that increases from the entrance louver 520 adjacent the first end of the base wall to the entrance louver 520 adjacent the turnaround rib 524. The exit louvers 522 have a width W that decreases from the exit louver 522 adjacent the turnaround rib 524 to the exit louver 522 adjacent the second end of the base wall. In the embodiment shown, the predetermined angles α, β from the base wall remain substantially constant for each of the louvers 520, 522. However, it is understood that these angles could vary between adjacent louvers as described for FIGS. 4-7 above.

Air flow through the louvers 517, 519 520, 522 is the same as described above for FIG. 3. It is understood that football shaped louvers as discussed in FIG. 5, and S-shaped louvers and reversed S-shaped louvers as discussed in FIG. 6 can be replaced for the louvers shown in this embodiment.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A flat tube heat exchanger comprising:

at least one header;

a plurality of spaced apart tubes in fluid communication with said header; and a plurality of fins disposed between said tubes, said fins further comprising:

a base wall having at least one longitudinal axis, a first end, a second end, and a middle portion;

at least one turnaround rib disposed in the middle portion of the base wall;

a plurality of spaced apart entrance louvers disposed between the first end of the base wall and the turnaround rib, the entrance louvers having a first edge and a second edge, the first edge disposed on a first side of the longitudinal axis and the second edge disposed on a second side of the longitudinal axis, a width of each of the entrance louvers defined as a distance between the first edge of each of the entrance louvers and the second edge of each of the entrance louvers, wherein the width of the entrance louvers increases moving from the first end of the base wall to the middle portion of the base wall, wherein each of the entrance louvers is disposed at a predetermined angle α in respect of the longitudinal axis of the base wall, the predetermined angle α decreasing for the entrance louvers moving from the first end of the base wall to the turnaround rib; and a plurality of spaced apart exit louvers disposed between the turnaround rib and the second end of the base wall, the exit louvers having a first edge and a second edge, the first edge disposed on a first side of the longitudinal axis and the second edge disposed on a second side of the longitudinal axis, a width of each of the exit louvers defined as a distance between the first edge of each of the exit louvers and the second edge of each of the exit louvers, wherein the width of the exit louvers decreases moving from the middle portion of the base wall to the second end of the base wall, wherein each of the exit louvers is disposed at a predetermined angle β in respect of the longitudinal axis of the base wall, the predetermined angle β decreasing for the exit louvers moving from the turnaround rib to the second end of the base wall, wherein at least one of the entrance louvers and the exit louvers has a shape in cross section configured to affect at least one of an airflow and a pressure drop through the entrance louvers and the exit louvers.

2. The heat exchanger according to claim 1, wherein the at least one of said entrance louvers and said exit louvers includes a first planar surface extending between the first edge and the second edge and a second planar surface extending between the first edge and the second edge, the first planar surface substantially parallel with the second planar surface.

3. The heat exchanger according to claim 2, wherein the at least one of said entrance louvers and said exit louvers is generally parallelogram shaped in cross section.

4. The heat exchanger according to claim 1, wherein the at least one of said entrance louvers and said exit louvers includes a first convex curved surface extending between the first edge and the second edge and a second convex curved surface extending between the first edge and the second edge.

5. The heat exchanger according to claim 4, wherein the at least one of said entrance louvers and said exit louvers is generally football shaped in cross section.

6. The heat exchanger according to claim 1, wherein the at least one of said entrance louvers and said exit louvers includes a first bend and a second bend formed between the first edge and the second edge.

7. The heat exchanger according to claim 6, wherein the at least one of said entrance louvers and said exit louvers is generally S-shaped in cross section.

8. The heat exchanger according to claim 1, wherein the first edges of at least one of said entrance louvers and said exit louvers are maintained substantially in a first plane, and the second edges of at least one of said entrance louvers and said exit louvers are maintained substantially in a second plane different from the first plane.

9. The heat exchanger according to claim 1, wherein each of the fins is bent along the length thereof at the middle portion of the base wall, wherein the at least one longitudinal axis includes a first longitudinal axis and a second longitudinal axis, wherein the first longitudinal axis and the second longitudinal axis are non-linear.

10. A high performance heat exchanger fin comprising:

a base wall having at least one longitudinal axis, a first end, a second end, and a middle portion;

at least one turnaround rib disposed in the middle portion of the base wall;

a plurality of spaced apart entrance louvers disposed between the first end of the base wall and the turnaround rib, the entrance louvers having a first edge and a second edge, the first edge disposed on a first side of the longitudinal axis and the second edge disposed on a second side of the longitudinal axis, a width of each of the entrance louvers defined as a distance between the first edge of each of the entrance louvers and the second edge of each of the entrance louvers, wherein the width of the entrance louvers increases moving from the first end of the base wall to the middle portion of the base wall, wherein each of the entrance louvers is disposed at a predetermined angle $\alpha$ in respect of the longitudinal axis of the base wall, the predetermined angle $\alpha$ decreasing for the entrance louvers moving from the first end of the base wall to the turnaround rib; and a plurality of spaced apart exit louvers disposed between the turnaround rib and the second end of the base wall, the exit louvers having a first edge and a second edge, the first edge disposed on a first side of the longitudinal axis and the second edge disposed on a second side of the longitudinal axis, a width of each of the exit louvers defined as a distance between the first edge of each of the exit louvers and the second edge of each of the exit louvers, wherein the width of the exit louvers decreases moving from the middle portion of the base wall to the second end of the base wall, wherein each of the exit louvers is disposed at a predetermined angle $\beta$ in respect of the longitudinal axis of the base wall, the predetermined angle $\beta$ decreasing for the exit louvers moving from the turnaround rib to the second end of the base wall, wherein at least one of the entrance louvers and the exit louvers has a shape in cross section configured to affect at least one of an airflow and a pressure drop through the entrance louvers and the exit louvers.

11. The heat exchanger fin according to claim 10, wherein the at least one of said entrance louvers and said exit louvers includes a first planar surface extending between the first edge and the second edge and a second planar surface extending between the first edge and the second edge, the first planar surface substantially parallel with the second planar surface.

12. The heat exchanger according to claim 11, wherein the at least one of said entrance louvers and said exit louvers is generally parallelogram shaped in cross section.

13. The heat exchanger fin according to claim 10, wherein the at least one of said entrance louvers and said exit louvers includes a first convex curved surface extending between the first edge and the second edge and a second convex curved surface extending between the first edge and the second edge.

14. The heat exchanger fin according to claim 13, wherein the at least one of said entrance louvers and said exit louvers is generally football shaped in cross section.

15. The heat exchanger fin according to claim 9, wherein the at least one of said entrance louvers and said exit louvers includes a first bend and a second bend formed between the first edge and the second edge.

16. The heat exchanger fin according to claim 15, wherein the at least one of said entrance louvers and said exit louvers is generally S-shaped in cross section.

17. The heat exchanger fin according to claim 10, wherein the first edges of at least one of said entrance louvers and said exit louvers are maintained substantially in a first plane, and the second edges of at least one of said entrance louvers and said exit louvers are maintained substantially in a second plane different from the first plane.

18. The heat exchanger fin according to claim 10, wherein the fin is bent along the length thereof at the middle portion of the base wall, wherein the at least one longitudinal axis includes a first longitudinal axis and a second longitudinal axis, wherein the first longitudinal axis and the second longitudinal axis are non-linear.

19. A high performance heat exchanger fin comprising:

a base wall having at least one longitudinal axis, a first end, a second end, and a middle portion;

at least one turnaround rib disposed in the middle portion of the base wall;

a plurality of spaced apart entrance louvers disposed between the first end of the base wall and the turnaround rib, the entrance louvers having a first edge and a second edge, the first edge disposed on a first side of the longitudinal axis and the second edge disposed on a second side of the longitudinal axis, a width of each of the entrance louvers defined as a distance between the first edge of each of the entrance louvers and the second edge of each of the entrance louvers, wherein the width of the entrance louvers increases moving from the first end of the base wall to the middle portion of the base wall, wherein each of the entrance louvers is disposed at a predetermined angle $\alpha$ in respect of the longitudinal axis of the base wall, the predetermined angle $\alpha$ decreasing for the entrance louvers moving from the first end of the base wall to the turnaround rib; and a plurality of spaced apart exit louvers disposed between the turnaround rib and the second end of the base wall, the exit louvers having a first edge and a second edge, the first edge disposed on a first side of the longitudinal axis and the second edge disposed on a second side of the longitudinal axis, a width of each of the exit louvers defined as a distance between the first edge of each of the exit louvers and the second edge of each of the exit louvers, wherein the width of the exit louvers decreases moving from the middle portion of the base wall to the second end of the base wall, wherein each of the exit louvers is disposed at a predetermined angle $\beta$ in respect of the longitudinal axis of the base wall, the predetermined angle $\beta$ decreasing for the exit louvers moving from the turnaround rib to the second end of the base wall, wherein at least one of the entrance louvers and the exit louvers has a shape in cross section configured to affect at least one of an airflow and a pressure drop through the entrance louvers and the exit louvers, wherein the at least one of the entrance louvers and the exit louvers is at least one of generally parallelogram shaped, generally football shaped, and generally S-shaped in cross section.

20. The heat exchanger fin according to claim 19, wherein the fin is bent along the length thereof at the middle portion of the base wall, wherein the at least one longitudinal axis includes a first longitudinal axis and a second longitudinal axis, wherein the first longitudinal axis and the second longitudinal axis are non-linear.

* * * * *